US009550355B2

(12) United States Patent
Love, III et al.

(10) Patent No.: US 9,550,355 B2
(45) Date of Patent: Jan. 24, 2017

(54) RESISTOR PROTECTED DEFLECTION PLATES FOR LIQUID JET PRINTER

(71) Applicant: Milliken & Company, Spartanburg, SC (US)

(72) Inventors: Franklin S. Love, III, Columbus, NC (US); David M. Hyslop, Roebuck, SC (US); Frank M. Pitman, Duncan, SC (US); Rajib Mondal, Greer, SC (US); Jeffrey J. Lillie, Peachtree City, GA (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 15/002,547

(22) Filed: Jan. 21, 2016

(65) Prior Publication Data

US 2016/0136946 A1 May 19, 2016

Related U.S. Application Data

(62) Division of application No. 13/480,599, filed on May 25, 212, now Pat. No. 9,452,602.

(51) Int. Cl.

| | |
|---|---|
| ***B41J 2/08*** | (2006.01) |
| ***B41J 2/035*** | (2006.01) |
| ***B41J 2/09*** | (2006.01) |

(52) U.S. Cl.

CPC .. *B41J 2/035* (2013.01); *B41J 2/09* (2013.01)

(58) Field of Classification Search

USPC ..... 347/9–10

See application file for complete search history.

(56) References Cited

U.S. PATENT DOCUMENTS

| | | | | |
|---|---|---|---|---|
| 3,798,656 A | | 3/1974 | Lowy et al. | 346/1 |
| 4,314,258 A | | 2/1982 | Donahue et al. | 346/75 |
| 4,845,512 A | * | 7/1989 | Arway | B41J 2/09 239/690 |
| 5,969,733 A | | 10/1999 | Sheinman | 347/75 |
| 6,003,980 A | | 12/1999 | Sheinman et al. | 347/78 |
| 6,106,107 A | | 8/2000 | Sheinman | 347/75 |

(Continued)

FOREIGN PATENT DOCUMENTS

| | | | | |
|---|---|---|---|---|
| EP | 0 487 259 | | 5/1992 | |
| JP | 56 111675 | | 9/1981 | |
| WO | WO 9408792 A1 | * | 4/1994 | B41J 2/09 |

OTHER PUBLICATIONS

Patent Cooperation Treaty PCT International Search Report. Date of Mailing: Jul. 16, 2013. International Application No. PCT/US2013/041756. International Filing Date: May 20, 2013.

*Primary Examiner* — Matthew Luu
*Assistant Examiner* — Lily Kemathe
(74) *Attorney, Agent, or Firm* — Brenda D. Wentz

(57) ABSTRACT

A liquid jet printing apparatus is provided having a nozzle for emitting a stream of liquid droplets toward a substrate, a charging section for providing an electrical charge to liquid droplets and a pair of electrically conductive deflection plates for creating an electrical field capable of deflecting the liquid droplets to a desired location on the substrate, wherein a resistor is provided between a power source and the electrical field to limit current from the power source during electrical arcing between the deflection plates, thereby minimizing disruption to the electrical field and minimizing electromagnetic pulses.

16 Claims, 4 Drawing Sheets

(56) References Cited

U.S. PATENT DOCUMENTS

| | | | | |
|---|---|---|---|---|
| 6,511,164 | B1 * | 1/2003 | Bajeux | B41J 2/08 347/74 |
| 7,104,634 | B2 | 9/2006 | Weksler et al. | 347/78 |
| 7,182,442 | B2 | 2/2007 | Sheinman | 347/85 |
| 7,438,396 | B2 | 10/2008 | Weksler et al. | 347/73 |
| 7,524,042 | B2 | 4/2009 | Weksler et al. | 347/81 |
| 7,594,717 | B2 | 9/2009 | Sheinman | 347/89 |
| 8,540,351 | B1 | 9/2013 | Love, III et al. | 347/76 |
| 2005/0280677 | A1 | 12/2005 | Shrivastava et al. | 347/77 |
| 2008/0106564 | A1 | 5/2008 | Lifshitz et al. | 347/15 |
| 2013/0314475 | A1 | 11/2013 | Love, III et al. | 347/82 |

* cited by examiner

FIG. –1–

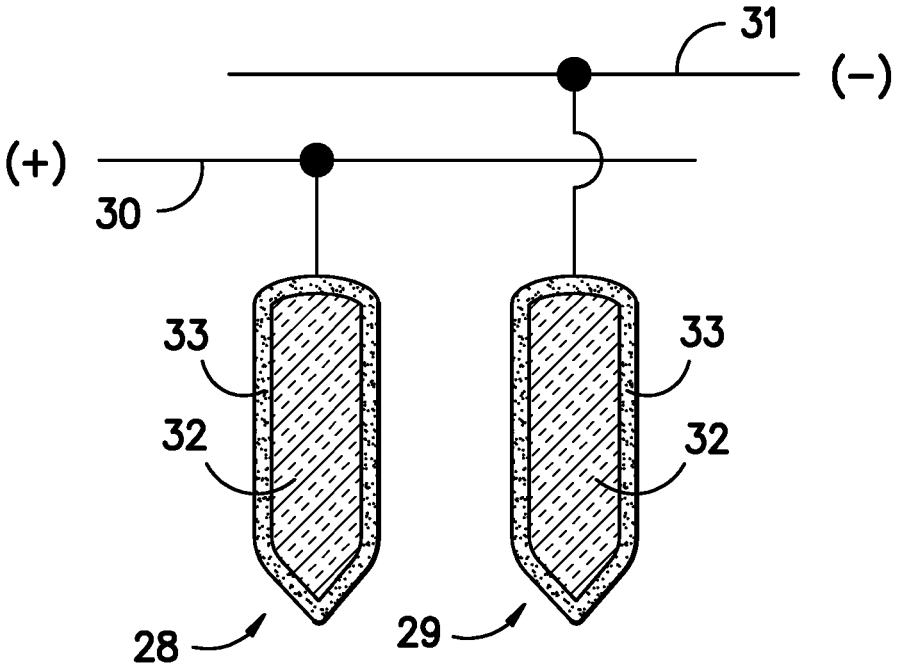
FIG. −4−
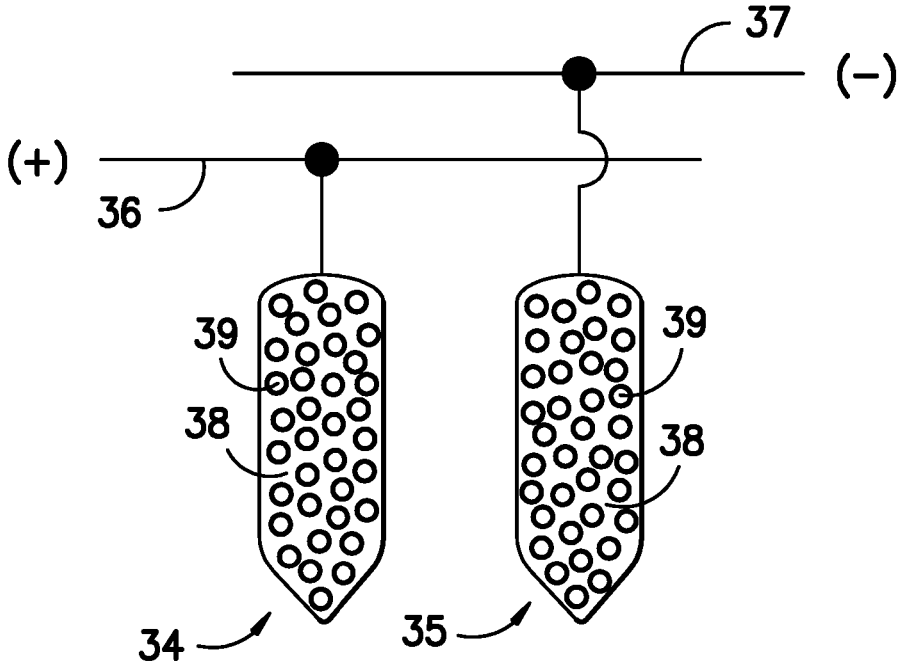
FIG. −5−

RESISTOR PROTECTED DEFLECTION PLATES FOR LIQUID JET PRINTER

CROSS-REFERENCE TO RELATED APPLICATIONS

This application claims priority to, and is a divisional of, U.S. patent application Ser. No. 13/480,599 filed May 25, 2012, entitled, "Resistor Protected Deflection Plates For Liquid Jet Printer," which is hereby entirely incorporated by reference.

FIELD OF THE INVENTION

This invention relates generally to a liquid jet printer having a pair of electrically charged deflection plates to direct the path of a droplet of liquid, and in particular to deflection plates having a resistor between the power source and the electrical field formed between the deflection plates, to minimize the effect of electrical arcing between the plates.

BACKGROUND OF THE INVENTION

U.S. Pat. No. 7,438,396 B2 discloses a continuous ink jet printer having an array of nozzles for simultaneously printing across the width of a substrate, such as a textile fabric. For each nozzle there is (i) a droplet formation section, such as a piezoelectric transducer, (ii) a droplet charging section, such as parallel metal plates, and (iii) a droplet deflection section, for directing the path of the droplet to the desired location on a substrate to be printed. The range of deflection of the droplets is such that adjacent nozzles can overlap, to print a seamless pattern on the substrate. The deflection plates are spaced apart and oppositely charged, for example at 1 to 5 kV, to produce an electrical field. The charge on the droplets and/or the strength of the electrical field created by the deflection plates can be varied, to create more or less deflection of the droplet. In one example, uncharged droplets are not deflected and collect in the gutter.

During operation of the printer, liquid can collect on the surface of the deflection plates, leading to arcing between the plates and a subsequent disruption of the electrical field and printer electronics.

SUMMARY OF THE INVENTION

The invention is directed to a liquid jet printing apparatus having a nozzle capable of emitting a stream of individual droplets of liquid toward a substrate, a droplet charging section capable of providing an electrical charge to the droplets, and a pair of spaced-apart, electrically charged deflection plates, downstream from the nozzle, for creating an electrical field capable of deflecting the droplets to a desired location of the substrate. The liquid jet printer may emit a continuous stream of liquid droplets or emit liquid droplets on demand. In the case of a continuous liquid jet printer, a collection device, such as gutter, is interposed between the nozzle and the substrate, to prevent at least some of the droplets from impinging upon the substrate, for example, when a particular color of liquid is not part of the pattern being printed. The collected droplets may be recycled to the droplet formation section.

A power source is connected to each of the deflection plates in an electrical circuit, to create a voltage differential between the plates. The electrical field formed in the space between the deflection plates is a function of the voltage. During operation of the printer, liquid droplets can accumulate on the surface of the deflection plates. The accumulation may be caused by splatters from the gutter, misdirected drops, or from rebound of ink off the surface of the substrate that is being printed. The accumulation can coalesce on the surface of the deflection plate reducing the effective gap to below the breakdown potential of air, and arcing from one plate to the adjacent oppositely charged plate can occur. High energy arcing between the deflection plates can cause a voltage drop, thereby disrupting the electrical field and interfering with control of the charged droplets of liquid. Additionally, the surge in current associated with high energy arcing can create an electromagnetic pulse ("EMP"), which can disrupt the printer electronics.

An object of the present invention is to minimize disruption of the electrical field between the deflection plates, by minimizing a drop in the voltage differential across the plates when arcing occurs. Another object of the invention is to minimize EMP events caused by a surge in current through the electrical circuit, as can be caused by arcing between the deflection plates. Yet another object of the invention is to minimize voltage drops and EMP events caused by arcing, without introducing inordinate delays in the recharge time of the resistor-capacitor circuit ("RC circuit") of the power supply/rail assembly (bus)/deflection plates, following arcing between the deflection plates. In particular, resistance values that are too high can result in RC circuit rise times that are too long for high speed printing, and will result in insufficient energy to blow liquid off of wet deflection plates.

The objectives of the invention are met by introducing a resistor into the electrical circuit between the power source and the electrical field created between the deflection plates, whereby the resistor substantially limits the current flow during electrical arcing between the deflection plates. In one embodiment of the invention, the power source creates a voltage differential across the deflection plates of from 4 to 8 KV, and a resistor having a resistance of from 1 to 100 megaohms is positioned in the electrical circuit between the power source and the electrical field between the deflection plates. In another embodiment of the invention, a resistor is positioned in the electrical circuit between the power source and the electrical field created between the deflection plates, wherein the resistor limits current from the power supply to 0.6 mA or less, during electrical arcing between the deflection plates.

The present invention is useful in applications having a plurality of pairs of deflection plates connected to a power source, whereby a first bus connects the negative terminal of the power source to the negative deflection plates and a second bus connects the positive terminal of the power source to the positive deflection plates. The buses (also referred to herein as rail assemblies), due to their relatively large metallic mass, effectively introduce a significant stray capacitance into the system. The objectives of the present invention may be met by providing multiple resistors, with one resistor positioned in the electrical circuit between the respective bus (positive or negative) and the electrical field created between the deflection plates. For example, one resistor may be positioned in the electrical circuit between the positive or negative bus and each positive or negative deflection plate, respectively. By placing a resistor just before each individual deflection plate, rather than between the power source and each bus, one may avoid both long RC circuit rise times and high energy arcing.

The resistors may be conventional, two terminal electrical components incorporated in the electrical circuit between the power source and the deflection plate, or the composition of the deflection plate itself may be selected to provide the level of resistance necessary to achieve the objectives of the present invention. It can also be understood that the desired resistance may be provided between the power source and the deflection plates by using a device other than a conventional resistor, such as a length of high-resistance wire or filament.

The present invention also includes a method of printing characterized by using the jet printing apparatus, incorporating the resistor protection, to print on a substrate, for example, as described in the various applications set forth herein.

BRIEF DESCRIPTION OF THE DRAWINGS

FIG. 4 is a cross-sectional view of a pair of high-resistive deflection plate having an insulator core and a conductive coating.

FIG. 5 is a cross-sectional view of a pair of high-resistive deflection plates having a conductive filler dispersed in a non-conductive matrix.

DETAILED DESCRIPTION OF THE INVENTION

Without limiting the scope of the invention, the preferred embodiments and features are hereinafter set forth. All of the United States patents, which are cited in the specification, are hereby incorporated by reference. Unless otherwise indicated, conditions are 25° C., 1 atmosphere of pressure and 50% relative humidity, concentrations are by weight, and molecular weight is based on weight average molecular weight.

The term "polymer" or "polymeric material" as used in the present application denotes a material having a weight average molecular weight (Mw) of at least 5,000. Such polymeric materials can be amorphous, crystalline, or semi-crystalline materials, including elastomeric polymeric materials.

Liquid Jet Printer

Figure 1:
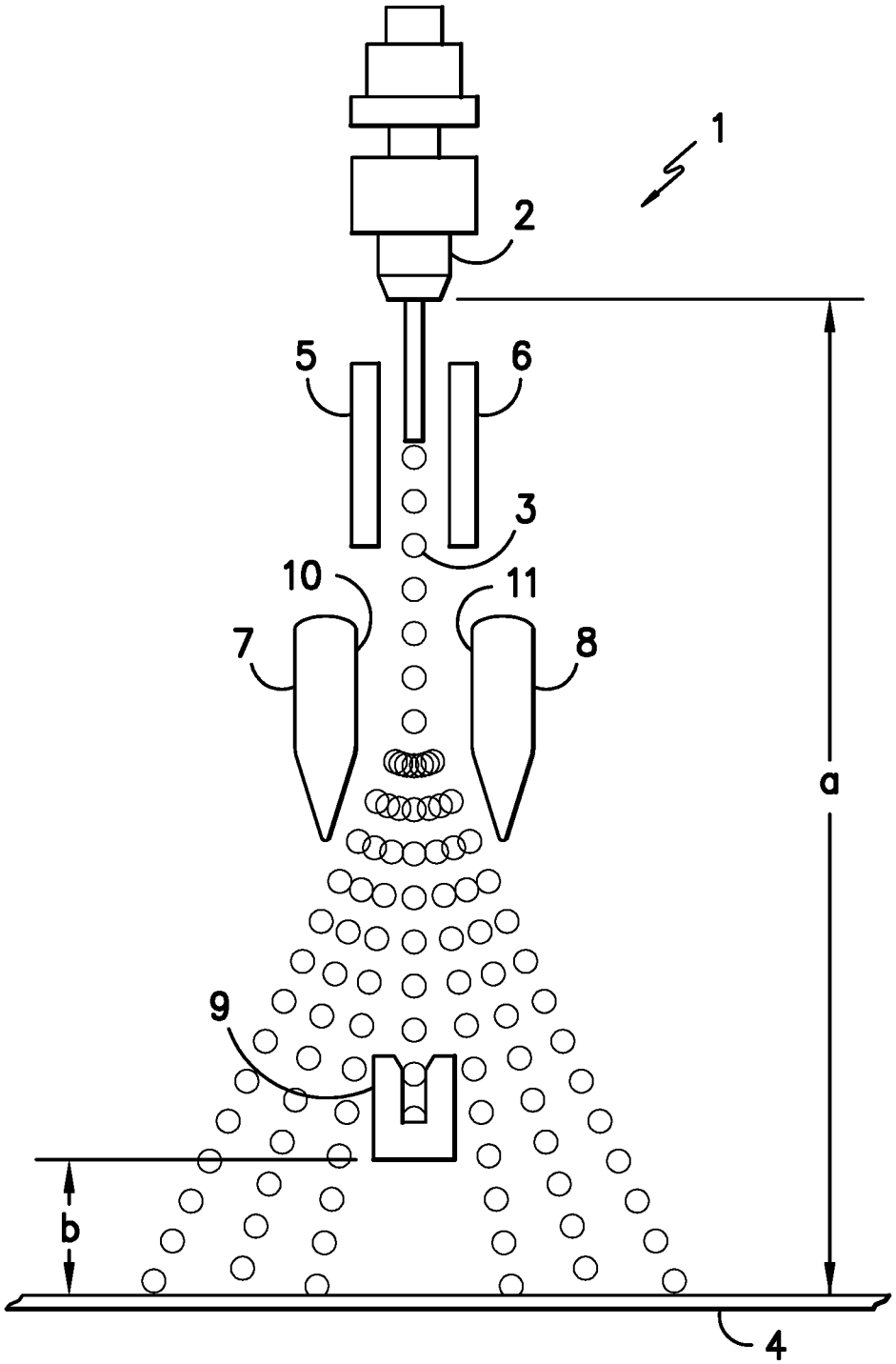
FIG. 1 is a side view depicting an arrangement of a nozzle, charging station, deflection station used to print on a substrate.

Referring to FIG. 1, the present invention is useful in combination with a liquid jet printer 1, having a nozzle 2 capable of emitting a stream of individual droplets of liquid 3 toward a substrate 4. The droplets may be created by a piezoelectric transducer, incorporated into nozzle 2. The droplets follow a path through charging plates 5 and 6, capable of providing an electrical charge to the liquid droplets, and a pair of electrically conductive deflection plates 7 and 8, for creating an electrical field capable of deflecting liquid droplets 3 to a desired location of substrate 4. The amount of deflection undergone by the droplets 3 can be controlled by varying the electrical charge placed on the droplet by charging plates 5 and 6, varying the electrical field created by deflection plates 7 and 8, or both varying the charge and the electrical field imposed upon an individual droplet.

Liquid jet printer 1 may emit a continuous stream of liquid droplets or emit liquid droplets on demand. In the case of a continuous liquid jet printer, a collection device, such as gutter 9, is interposed between nozzle 2 and the substrate 4, to prevent liquid droplets 3 from impinging upon substrate 4, for example, when a particular color of liquid is not part of the pattern being printed. In the example shown, gutter 9 is positioned to collect undeflected liquid droplets 3. It may be understood that the gutter can be positioned to collect deflected liquid droplets, and the droplets that are not intended to impinge upon the substrate can be deflected to the gutter. Each of the deflection plates 7 and 8 has an interior side 10 and 11, respectively, facing the path of the stream of liquid droplets 3. The edges of deflection plates 7 and 8 may be rounded to prevent arcing by reducing field intensity. By way of example, the distance "a" between nozzle 2 and substrate 4 may be 58 mm, and the distance "b" between gutter 9 and substrate 4 may be 8 mm.

Examples of liquid jet printers compatible with the present invention may be found in U.S. Pat. No. 7,438,396 B2; U.S. Pat. No. 7,594,717 B2; U.S. Pat. No. 7,524,042 B2; U.S. Pat. No. 7,182,442 B2; U.S. Pat. No. 7,104,634 B2; U.S. Pat. No. 6,106,107; U.S. Pat. No. 6,003,980; U.S. Pat. No. 5,969,733; and US 2008/0106564 A1.

The liquid printer of the present invention may be one or a plurality of nozzles, for example, one nozzle each for black, cyan, magenta and yellow colorant, that travel from side-to-side across a substrate, as the substrate is transported longitudinally relative to the printer. Alternatively, an array of stationary nozzles is provided across the width of the substrate. The spray patterns of the nozzles may abut or overlap to provide complete coverage. In both examples, each nozzle is coupled with a droplet charging section capable of providing an electrical charge to the droplets, and a pair of spaced-apart, electrically charged deflection plates, downstream from the nozzle, for creating an electrical field capable of deflecting the droplets to a desired location of the substrate.

The present invention may employ a variety of liquid compositions. By way of example, the composition may be aqueous or non-aqueous. A colorant present in the composition may be a dye or pigment. The composition may also include binders, dispersants, co-solvents, surface energy modifiers, such as glycol, and salts. The present invention is useful with liquid compositions incorporating a colorant, for example, an acid dye, a disperse dye and/or a reactive dye. In one embodiment of the invention, the liquid is an aqueous composition having a dye dissolved therein.

Resistor Protected Deflection Plates

The liquid jet printer may be provided with an array of nozzles for emitting a stream of individual droplets across the width of a substrate, as the substrate passes through the apparatus in a longitudinal direction. Each unit of the array has a charging section and a pair of oppositely charged deflection plates. The electrical circuit may include a first bus, connecting the negatively charged deflection plate of each pair to the negative terminal of the power source, and a second bus, connecting the positively charged deflection plates of each pair to the positive terminal of the power source.

In one embodiment of the invention, a plurality of resistors are provided, wherein one resistor is positioned in the electrical circuit between the first (negative) bus and the electrical field created between each pair of deflection plates and one resistor is positioned between the second (positive) bus and the electrical field created between each pair of deflection plates, and wherein the resistors limit the current from the power supply.

The resistor values of the resistors are selected to achieve the objectives of the invention, that is, to balance the objective of minimizing voltage drop and EMP events, without introducing inordinate delays in RC circuit rise times. For voltages across the deflection plate in the range of 4K to 8 KV, resistors having values in the range of 1 to 100 megaohms, in particular, 10 to 30 megaohms are believed to be useful. Alternatively, the resistor may be characterized by limiting the current from the power supply to 0.3 mA or less, in particular, 0.1 mA or less, during electrical arcing between the deflection plates.

Additionally, an unexpected advantage of the present invention is based on the observation that a low-energy arcing event results in liquid that has collected on the surface of the deflection plate to be blown off. For example, a current surge of 0.1 mA to 0.3 mA has been found to blow collected liquid from the surface of the deflection plates. Accordingly, in one embodiment of the invention, the resistance should not be so high as to prevent any electrical arcing to occur at all.

Figure 2:
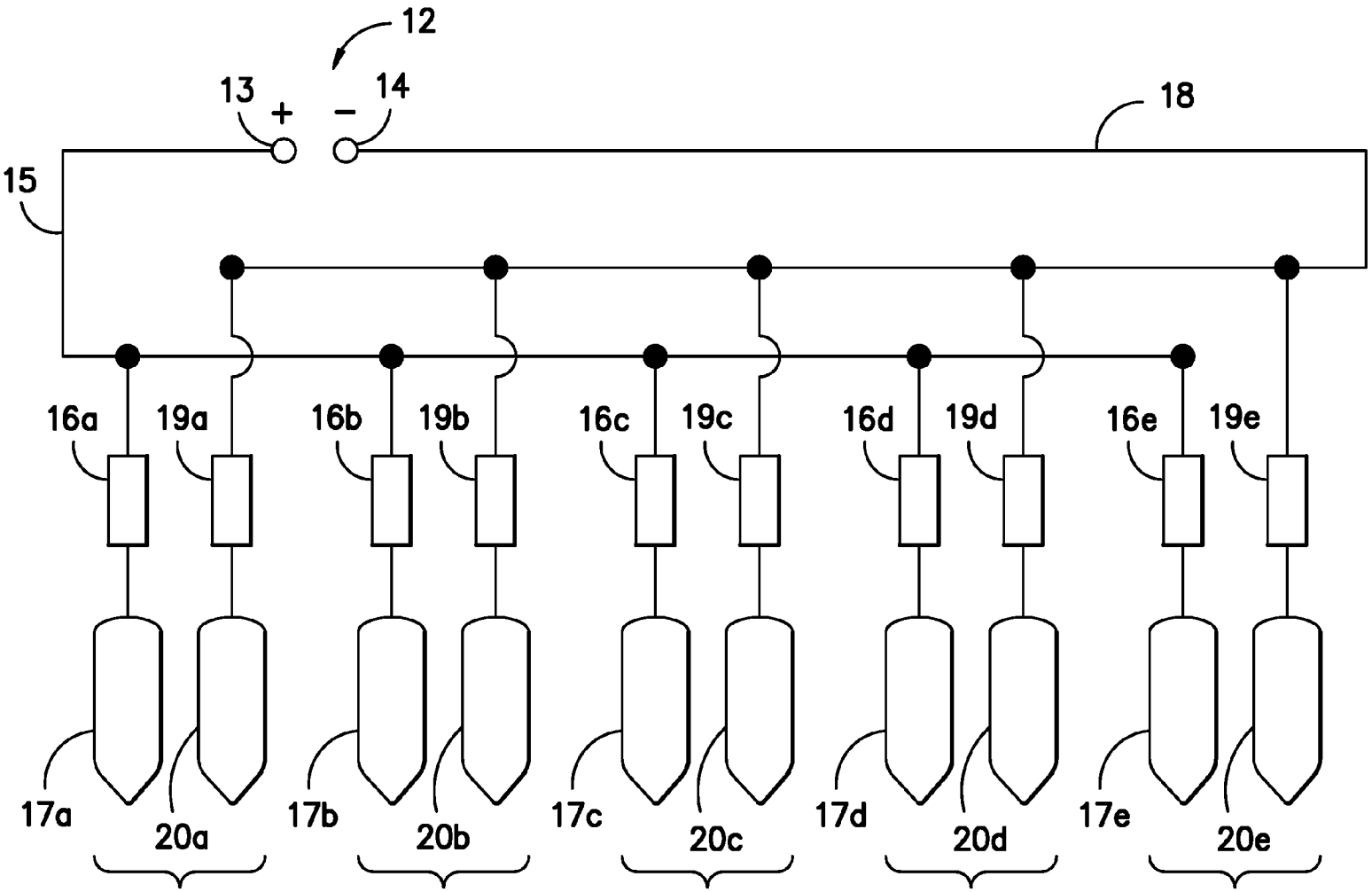
FIG. 2 is a schematic view of the power source, buses, resistors and deflection plates.

Referring to FIG. 2, a schematic diagram is provided of one embodiment of the invention, wherein the resistor is a conventional, two-terminal resistor inserted in the electrical circuit between the power source and one of the deflection plates. Power source 12 has positive terminal 13 and negative terminal 14. Positive terminal 13 is connected to bus 15, which is connected in an electrical circuit first to resistors 16*a*-16*e* and then to positive deflection plates 17*a*-17*e*. Similarly, negative terminal 14 is connected to bus 18, which is connected in an electrical circuit first to resistors 19*a*-19*e* and then to negative deflection plates 20*a*-20*e*.

The metallic mass of each bus (rail assembly) represents stray capacitance within the RC circuit. If a single resistor was positioned in the electrical circuit between the power source and each bus, there is a risk that the bus capacitance may contribute to high energy arcing between the deflection plates and to long RC circuit rise times. Because the metallic mass of the each plate is relatively small, positioning a resistor in the electrical circuit after the bus and just before each deflection plate minimizes the stray capacitance and therefore the RC rise time and stored energy available for an arc downstream of the resistor.

The resistor may be a fixed resistor or variable resistor, with fixed resistors being preferred for cost, space and simplicity. Examples of suitable fixed resistors include composition type, such as carbon composite resistors, wire-wound type, and film type, such as metal film, carbon film and metal oxide film resistors.

Figure 3:
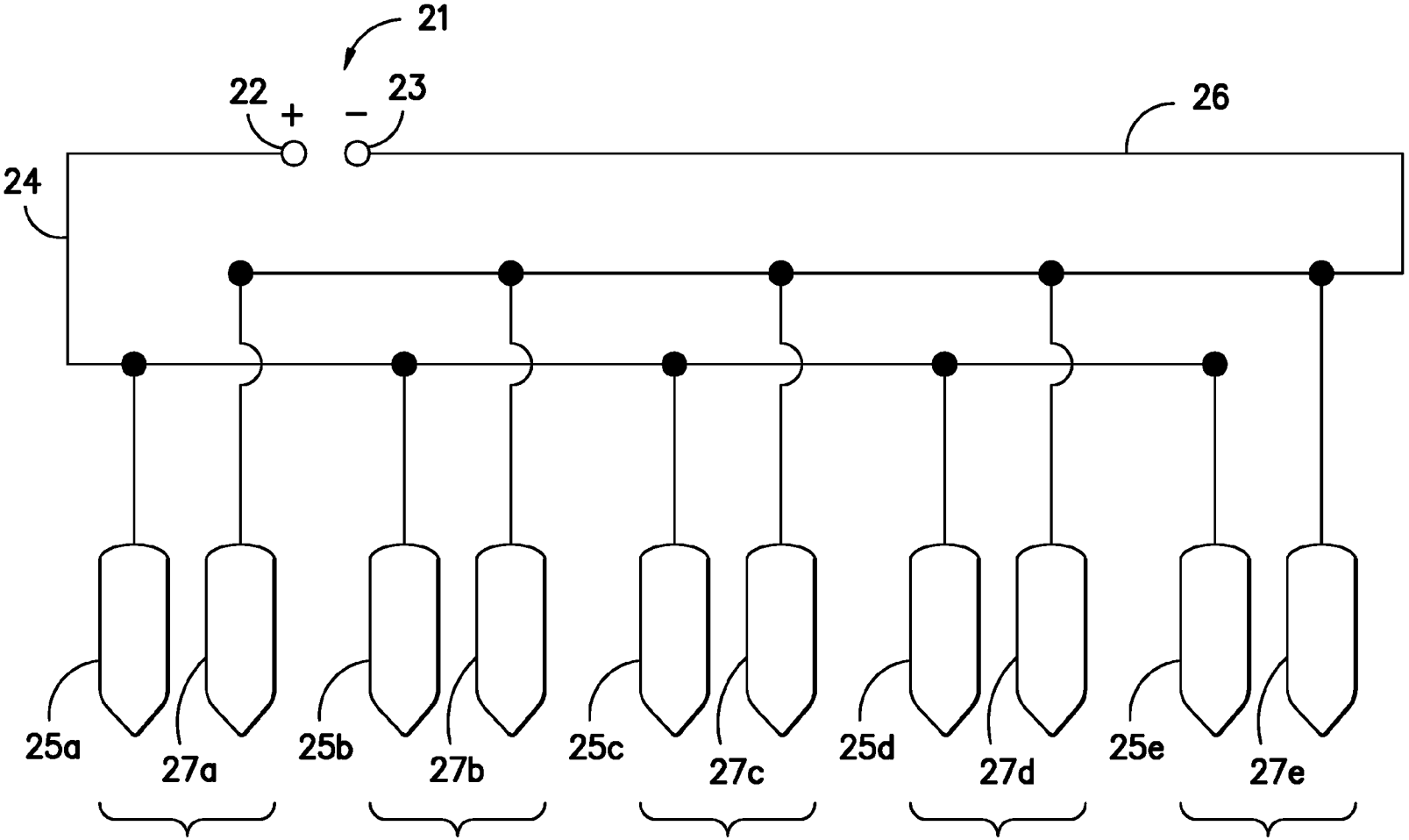
FIG. 3 is a schematic view of the power source, buses and high-resistive deflection plates.

Prior art deflection plates are typically made from conductive metals, such as aluminum, stainless steel or copper. In another embodiment of the present invention, however, the desired resistance is achieved by providing deflection plates that have been constructed from materials selected to provide the desired resistance between the power source and the electrical field between the deflection plates. Referring to FIG. 3, a schematic diagram shows power source 21 having positive terminal 22 and negative terminal 23. Positive terminal 22 is connected to bus 24, which is connected in an electrical circuit to positive, high-resistivity deflection plates 25*a*-25*e*. Similarly, negative terminal 23 is connected to bus 26, which is connected in an electrical circuit to negative, high-resistivity deflection plates 27*a*-27*e*.

Referring to FIG. 4, a pair of high-resistivity deflection plates 28 and 29 are connected to positive bus 30 and negative bus 31, respectively. Each of the high-resistivity deflection plates 28 and 29 are constructed with an insulator core 32 and a conductive coating 33. By way of example, the insulator core 32 may be glass, ceramic, or a non-conductive polymer, including polyolefins, polyamides, polyesters, polyurethanes, and elastomers. The conductive coating 33 may be a weakly conductive material, including conductive polymers, such as polyaniline and polypyrrole, non-conductive polymers having conductive fillers dispersed therein, or metal/metal oxide/metal nitride composites. The conductive coating may be applied from solution or vapor deposition technique.

Referring to FIG. 5, in an alternative embodiment of the invention, high-resistivity deflection plates 34 and 35 are connected to positive bus 36 and negative bus 37, respectively. Each of deflection plates 34 and 35 may be a composition comprising an insulator phase 38 and a conductive filler 39 dispersed in insulator phase 38. By way of example, insulator phase may be a matrix formed by a non-conductive polymer, and the conductive filler dispersed in the matrix may be selected from fibers and particles of metals, metal oxides and carbon. The resistance of the deflection plate can be readily adjusted by varying the amount of conductive filler dispersed in the composition.

The preceding description of the invention is directed to a liquid printer having an array of nozzles. It is to be understood, however, that the resistor protected deflection plates of the present invention may be a single pair of deflection plates in an electrical circuit with a power source, or an array comprising multiple pairs of deflection plates, with each pair connected in an electrical circuit with a power source, to create an electrical field between oppositely charged deflection plates.

Example 1

A 10 megohm resistor was wired in series with each of two deflector plates and one plate was connected to the positive output and one plate was connected to the negative output of a regulated EMCO high voltage power supply. The applied voltage was −3000 volts on one plate and +3000 volts on the other plate. The current capacity of the power supply was 0.5 mA. When the plates were wet with ink, the resulting arc was very small, silent, and almost impossible to see, and the color was a dim purple. The power supply voltage did not oscillate or drop during arcing.

Example 2

The test described in Example 1 was repeated, except that 33 megohm resistors were substituted for the 10 megaohm resistors. The results were the same as in Example 1, except that the arcs were smaller and dimmer.

Example 3

The test described in Example 1 was repeated, except that 100 megohm resistors were substituted for the 10 megaohm resistors. The results were the same as in Examples 1 and 2, except that the arcs were smaller and dimmer.

Example 4

Comparative

The test described in Example 1 was repeated, except that the resistors were effectively taken out of the circuit by jumpering around them. The arc was a loud snap, the size was much larger, and the color was a bright blue. The power supply voltage dropped by several hundred volts.

Applications

The present invention is useful in both continuous and on-demand liquid jet printers employing charged deflection plates to direct the application of liquid droplet to a substrate. Useful substrates include paper, polymer film and textiles, including woven and knitted fabrics, carpet, rugs and carpet tile, and including textiles made of natural and synthetic fibers or combinations thereof. Of particular interest is the use of aqueous liquid compositions containing acid dyes, in combination with substrates containing nylon fibers.

The invention may be further understood by reference to the following claims.

We claim:

1. An apparatus for printing on a substrate, comprising:

(a) a nozzle capable of emitting a stream of individual droplets of liquid toward the substrate;

(b) a droplet charging section, downstream from the nozzle, capable of providing an electrical charge to the droplets;

(c) a pair of spaced-apart, electrically conductive deflection plates, downstream from the nozzle;

(d) a power source connected by an electrical circuit to the deflection plates to provide a voltage differential across the deflection plates and create an electrical field capable of deflecting the droplets to a desired location of the substrate;

(e) a resistor positioned in the electrical circuit between the power source and the electrical field created between the deflection plates, wherein the resistor limits current from the power source to 0.1 to 0.3 mA, during electrical arcing between the deflection plates.

2. The apparatus of claim 1, wherein the resistor is positioned between the power source and the deflection plate.

3. The apparatus of claim 2, wherein the resistor is selected from the group consisting of composition type, wirewound type, and film type resistors.

4. The apparatus of claim 1, wherein the deflection plates function as the resistor.

5. The apparatus of claim 4, wherein the deflection plates are selected from the group consisting of (i) an insulator core and a conductive coating; and (ii) a composition comprising an insulator phase and a conductive filler dispersed in the insulator phase.

6. The apparatus of claim 1, wherein the power source creates a voltage differential across the pair of deflection plates of from 4 KV to 8 KV.

7. An apparatus for printing on a substrate, comprising:

(a) a plurality of nozzles capable of emitting a stream of individual droplets of liquid toward the substrate;

(b) a plurality of droplet charging sections, each positioned downstream from one of the nozzles, capable of providing an electrical charge to the droplets;

(c) a plurality of pairs of spaced-apart, electrically conductive deflecting plates, each of the pairs comprising a negative deflection plate and a positive deflection plate, and each of the pairs positioned downstream from the nozzles;

(d) a power source connected by an electrical circuit to each pair of deflection plates to provide a voltage differential across the deflection plates and create an electrical field capable of deflection the droplets to a desired location of the substrate, whereby the electrical circuit comprises a first bus connecting the negative terminal of the power source to the negative deflection plates and a second bus connecting the positive terminal of the power source to the positive deflection plates;

(e) a plurality of resistors, wherein one of the resistors is positioned in the electrical circuit between the first bus and the electrical field created between each pair of deflection plates and one of the resistors is positioned in the electrical circuit between the second bus and the electrical field created between each pair of deflection plates, and wherein the resistors limit current from the power source to 0.1 to 0.3 mA, during electrical arcing between the deflection plates.

8. The apparatus of claim 7, wherein the resistors are positioned in the electrical circuit between either the first or second bus and a deflection plate.

9. The apparatus of claim 8, wherein the resistors are selected from the group consisting of composition type, wirewound type, and film type resistors.

10. The apparatus of claim 7, wherein the resistors have a resistance value of from 1 to 100 megaohms.

11. The apparatus of claim 7, wherein the wherein the power source creates a voltage differential across the pair of deflection plates of from 4 KV to 8 KV.

12. The apparatus of claim 7, wherein the power source creates a voltage differential across the pair of deflection plates of from 4 KV to 8 KV and wherein the resistors have a resistance value of from 1 to 100 megaohms.

13. The apparatus of claim 7, wherein the deflection plates function as the resistor.

14. The apparatus of claim 13, wherein the deflection plates are selected from the group consisting of (i) an insulator core and a conductive coating; and (ii) a composition comprising an insulator phase and a conductive filler dispersed in the insulator phase.

15. The apparatus of claim 7, wherein the resistors are positioned in the electrical circuit between either the first or second bus and a deflection plate, the power source creates a voltage differential across the pair of deflection plates of from 4 KV to 8 KV, the resistors have a resistance value of from 1 to 100 megaohms, and wherein the resistors are selected from the group consisting of composition type, wirewound type, and film type resistors.

16. A method of printing on a substrate, comprising the steps of:

(a) emitting a stream of individual droplets of liquid toward the substrate through each of a plurality of nozzles;

(b) providing an electrical charge to the droplets, whereby each stream of droplets passes through one of a plurality of droplet charging sections, each positioned downstream from one of the nozzles;

(c) providing a plurality of pairs of spaced-apart, electrically conductive deflecting plates, each of the pairs comprising a negative deflection plate and a positive deflection plate, and each of the pairs positioned downstream from one of the nozzles;

(d) creating an electrical field between each pair of deflection plates with a power source connected by an electrical circuit to each pair of deflection plates to provide a voltage differential across the deflection plates and create an electrical field capable of deflection the droplets to a desired location of the substrate, whereby the electrical circuit comprises a first bus connecting the negative terminal of the power source to the negative deflection plates and a second bus connecting the positive terminal of the power source to the positive deflection plates;

(e) deflecting the droplets in each stream by passing the charged droplets from each stream through the deflection plates, and (f) whereby a plurality of resistors is provided, wherein one of the resistors is positioned in the electrical circuit between the first bus and the electrical field created between each pair of deflection plates and one of the resistors is positioned in the electrical circuit between the second bus and the electrical field created between each pair of deflection plates, wherein the resistors limit current from the power source to 0.1 to 0.3 mA, during electrical arcing between the deflection plates.

* * * * *